United States Patent [19]

Lew et al.

[11] Patent Number: 4,829,905

[45] Date of Patent: May 16, 1989

[54] DECOY DEPLOYING ICBM WARHEAD

[76] Inventors: Hyok S. Lew, 7890 Oak St., Arvada, Colo. 80005; Michael Stranahan, P.O. Box 15, Woody Creek, Colo. 81656

[21] Appl. No.: 623,453

[22] Filed: Jun. 22, 1984

[51] Int. Cl.[4] ..... F42B 13/00; F42B 13/50

[52] U.S. Cl. ..... 102/489; 102/505; 342/5

[58] Field of Search ..... 89/1.11; 102/340, 342, 102/351, 357, 489, 501, 505, 506; 343/18 B, 18 E; 244/3.1, 14, 160; 342/5, 12

[56] References Cited

U.S. PATENT DOCUMENTS

| | | | |
|---|---|---|---|
| 3,916,794 | 11/1975 | Mayer | 102/489 |
| 4,119,037 | 10/1978 | Romer et al. | 102/489 |
| 4,167,009 | 9/1979 | Schwartz | 102/351 |
| 4,340,197 | 7/1982 | Campbell | 244/3.1 |
| 4,345,254 | 8/1982 | Skomal | 343/18 E |
| 4,357,611 | 11/1982 | Skomal | 343/18 E |

*Primary Examiner*—Harold J. Tudor

[57] ABSTRACT

This invention relates to an ICBM warhead including a plurality of warheads wherein at least one warhead includes a plurality of dummy warhead shells having an external configuration matched to the real warhead and a radar image resembling the radar image of the real warhead. The stacks of these dummy warhead shells are attached to one or both extremities of the real warhead in a coaxial relationship thereto and secured together forming a package comprising a plurality of dummy warhead shells and a real warhead, which package includes means for separating the dummy warheads and real warhead from each other after the ICBM warhead is launched into space. The dummy warheads separated from each other and from the real warhead and following essentially the same trajectory as the real warhead, which provide the same radar image as the real warhead, practically make it impossible to identify and intercept the real warhead by overwhelming any star war defense and strategy.

4 Claims, 2 Drawing Sheets

DECOY DEPLOYING ICBM WARHEAD

BACKGROUND OF THE INVENTION

The primary object of the present invention is to show that the space war concept for intercepting incoming nuclear warheads is nothing more than a dream of fools, for the most technically sophisticated method in ABM technology can be completely nullified by a totally mundane warhead as exemplified by the present patent application.

Another object of the present invention is to show that ABM technology is no match for Counter ABM technology in terms of the technological disparity as well as imbalance in financial burden therebetween.

A further object of the present invention is to provide a decoy deploying ballistic warhead technology that can be incorporated into conventional ballistic warheads with an additional expense of only a few thousand dollars and yet will render a multibillion dollar ABM system completely useless.

These and other objects of the present invention will become clear as the description thereof proceeds.

BRIEF DESCRIPTION OF FIGURES

The present invention may be described with a great clarity and specificity by referring to the following Figures.

SPECIFICATION

Figure 1:
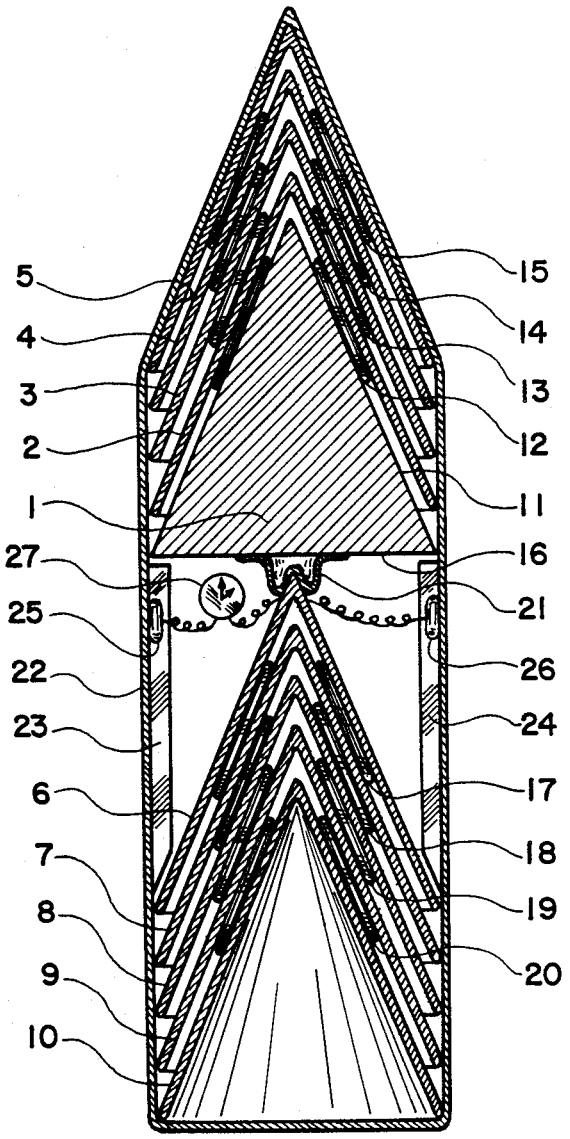
FIG. 1 illustrates a cross section of a decoy deploying ICBM warhead taken along a plane including the central axis of the ICBM warhead.

In FIG. 1, there is illustrated a cross section of a decoy deploying ICBM warhead constructed in accordance with the principles of the present invention, which cross section is taken along a plane including the central axis of the real warhead. The decoy deploying ICBM warhead comprises a real warhead or a MIRV package 1, a first plurality of dummy warhead shells 2, 3, 4, 5, etc., of conical shell construction having configurations matched to the external configuration of the real warhead 1 and a second plurality of dummy warhead shells 6, 7, 8, 9, 10, etc., of conical shell construction having configurations matched to the external configuration of the real warhead 1. These dummy warhead shells are constructed in structures and surface finishes to provide substantially the same radar image as the real warhead, making it indistinguishable from the real warhead. The first plurality of the dummy warhead shells 2, 3, 4, 5, etc. are stacked on top of the leading end 11 of the real warhead 1 wherein the spring bias means comprising gas bags 12, 13, 14, 15, etc., are disposed intermediate the leading end 11 of the real warhead 1 and the dummy warhead shell 2 and intermediate each adjacent pair of the dummy warhead shells stacked on top of the leading end 11 of the real warhead 1. The second plurality of the dummy warhead shells 6, 7, 8, 9, 10, etc., are stacked to each other and disposed behind the trailing end 16 of the real warhead 1. The spring bias means comprising gas bags 17, 18, 19, 20, etc., are disposed intermediate each adjacent pair of the dummy warhead shells 6, 7, 8, 9, 10, etc. The gas bag 21 provides the spring bias means between the trailing end 16 of the real warhead 1 and the stacked pack of the dummy warhead shells 6, 7, 8, 9, 10, etc. The first stack of the dummy warhead shells 2, 3, 4, 5, etc., disposed on top of the leading end of the real warhead 1 and the second stack of the dummy warhead shells 6, 7, 8, 9, 10, etc., disposed behind the trailing end 16 of the real warhead 1 are connected to the real warhead by the tie-down strips or membraneous enclosure 22 wherein a plurality of spacers 23, 24, etc., are employed in providing a stable structure combination between the real warhead 1 and the second stack of the dummy warhead shells disposed behind the trailing end of the real warhead 1. Means 25, 26, etc., for releasing the connection means 22 tying down the packages together is attached to the connection means 22 which may be the tie-down straps or a membraneous enclosure. The releasing means 25, 26, etc., may be activated by a timing clock 27 or by a triggering sensor or by a remotely controlled triggering mechanism.

As mentioned in the preceding paragraphs, the individual dummy warhead shells and the real warhead are spring-biased from each other wherein they are compressed against the spring-biased spacing therebetween into a single compact package. The dummy warhead shells and the real warhead are packaged into one single assembly by using tie down strips or cords, or they are enclosed within a membraneous enclosure, wherein a plurality of spacer elements may be included to stabilize the packaging thereof. The individual dummy warhead shells and the real warhead are separated from each other by virtue of the spring-biased spacing therebetween such as the gas bags, conical coil springs, stretched elastic membranes, etc., as soon as the tying down means such as the tie-down straps or cords or the membraneous enclosure enveloping them is cut loose. The tying-down straps or cords or membraneous enclosure may be cut loose by such well known methods as the instant combustion or explosive disconnection of the connection thereof. The instant combustion or explosive disconnection may be realized by a charge generating high temperature or an explosion which can be triggered by a trigger mechanism activated by a pressure switch, timed clock, remotely transmitted electro magnetic signals, etc.

Figure 6:
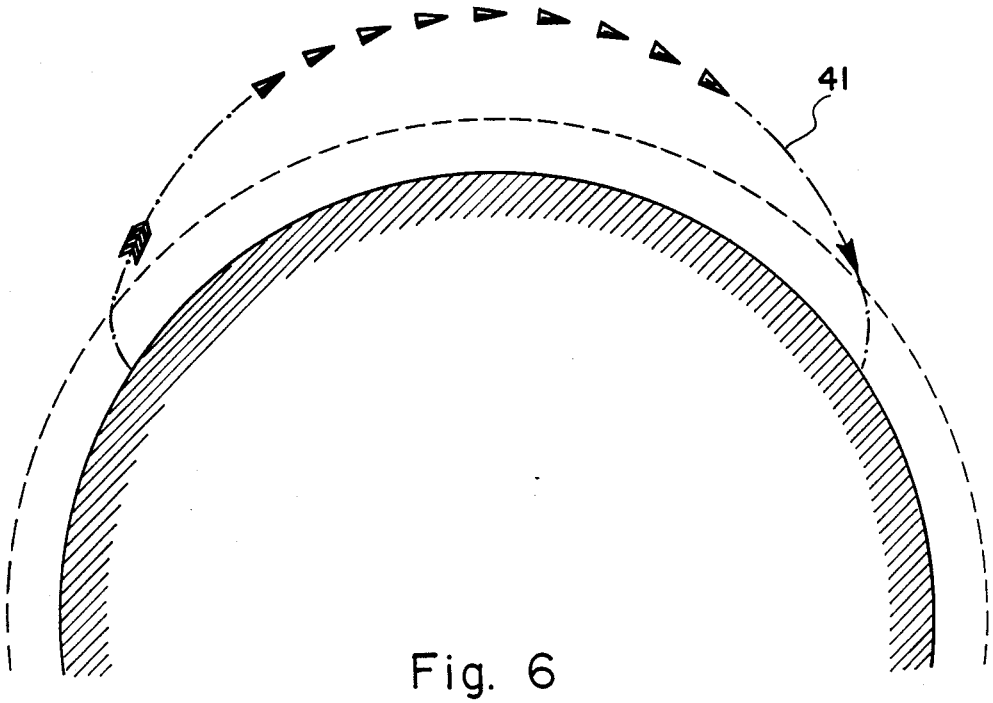
FIG. 6 illustrates a plurality of decoying dummy warheads deployed by a real warhead wherein the combination thereof forms a indistinguishable train of warheads following approximately the same trajectory.

When the decoy deploying ICBM warhead shown in FIG. 1 is launched into a space trajectory, the connection means 22 such as the tie-down strip or the membraneous enclosure is released as soon as the warhead package enters outer space where no air resistance against a moving projectile exists. Once the connection means 22 is released, the spring bias means comprising gas bags 12, 13, 14, 15, 17, 18, 19, 20, 21 etc., separates the dummy warhead shells and the real warhead from each other and spreads them into a train of indistinguishable warheads having identical radar images which follow approximately the same trajectory as illustrated in FIG. 6. The spread of the train of indistinguishable warheads become longer and longer as those warheads approach the re-entry point above the target area. As the radar images of the dummy warhead shells are the same as that of the real warhead and an unspecified number of the dummy warhead shells can be deployed in front of the real warhead or behind the real warhead, it is impossible to single-out the real warhead and intercept it with an ABM device. The most technically feasible method of intercepting an ICBM warhead is to launch an intercepting missile on a trajectory tangentially merging with the trajectory of the ICBM warhead at the point of interception where the ICBM warhead runs into an intercepting net of mechanical or energy form. The real warhead moving behind an unspecified number of dummy warhead shells is immune from such a method of interception because the dummy warhead shells leading the real warhead plays the role of a space-mine sweeper as the leading dummy warhead shell crashes into the intercepting net and clears the path for the other dummy warhead shells and real warhead trailing it. It should be understood that the principles of the present invention for constructing a decoy deploying ICBM warheads can be applied to the MIRV package as well as to individual warheads packaged in a MIRV pack. If a MIRV pack deploys ten dummy warheads shells and each of three individual warheads included in a MIRV pack deploys ten dummy warheads, the launching of single MIRV ICBM creates forty different projectiles comprising three real warheads and thirty seven dummy warheads. Launching of one hundred MIRV'ed ICBMs with three individual warheads packed in each MIRV pack deploys four thousand objects in space wherein any three hundred of four thousand objects in that space can be real warheads. Launching of one thousand MIRV'ed ICBMs deploys forty thousand objects in space wherein any of three thousand out of forty thousand objects heading to a target country can be real warheads. It does not take much argument or analysis to conclude that it is impossible either to account for all forty thousand possible warheads or to intercept all forty thousand possible warheads. In conclusion, in view of technical as well as financial terms, it takes a fool to insist upon accounting and intercepting forty thousand possible warheads rapidly approaching the target country. The spring bias means separating and spreading the dummy warhead shells and the real warhead, and the mass of the dummy warhead shells can be designed so that the release of the dummy warhead shells from the real warhead does not change the velocity of the real warhead as the momentum imparted by the dummy warhead shells deployed in front of the real warhead is canceled by that of the dummy warhead shells deployed behind the real warhead.

Figure 2:
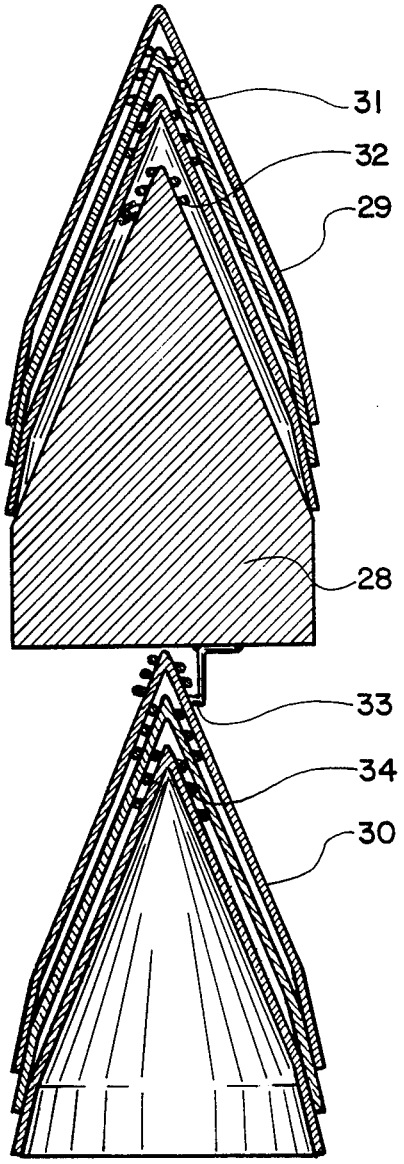
FIG. 2 illustrates a cross section of another decoy deploying ICBM warhead taken along a plane including the central axis of the ICBM warhead.

In FIG. 2, there is shown a cross section of another decoy deploying ICBM warhead taken along a plane including the central axis of the real warhead. The real warhead 28 has a configuration comprising conical leading half and a cylindrical trailing half. A first stack 29 of the dummy warhead shells of configurations matched to the external configurations of the real warhead 28 is stacked on top of the leading end of the real warhead 28, while a second stack 30 of the dummy warhead shells is disposed behind the trailing end of the real warhead 28. The cylindrical portion of the dummy warhead shell is provided with a small amount of taper so that the dummy warhead shells can be stacked up in a tight arrangement. Of course, the cylindrical portion of the real warhead 28 may be provided with a small amount of taper whereby the first stack 29 of the dummy warhead shells can be stacked on top of the leading end of the real warhead 28 leaving a little gap therebetween. The spring bias means for separating and spreading the dummy warhead shells from each other as well as from the real warhead comprises a plurality of conical springs 31, 32, 33, 34, etc. The connecting means such as the straps or membraneous enclosure and structural spacers illustrated in FIG. 1, are not included in FIG. 2 for brevity of illustration.

Figure 3:
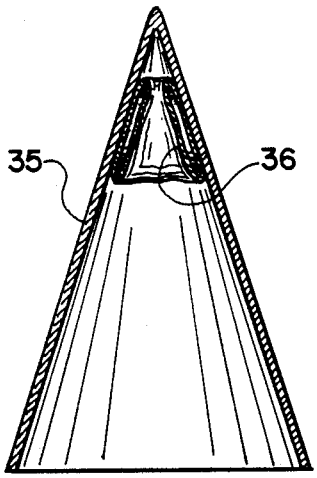
FIG. 3 illustrates means for spring-biased deployment of dummy warheads.

In FIG. 3, there is shown a cross section of a dummy warhead shell 35 of configurations matched to the external configurations of the real warhead, which cross section is taken along a plane including the central axis of the dummy warhead shell. The spring bias means for deploying the dummy warhead shells is a gas bag 36 of conoidal shell geometry, which is compressed to a thin shell when a dummy warhead shell 35 is stacked on top of another dummy warhead shell in a compressed arrangement.

Figure 4:
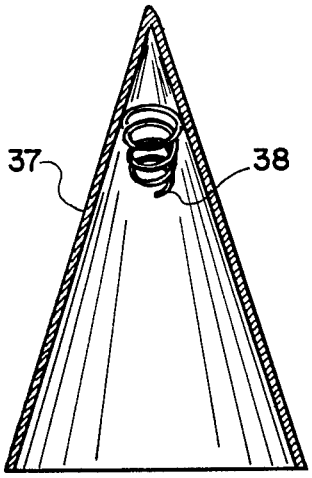
FIG. 4 illustrates another means for spring-biased deployment of dummy warheads.

In FIG. 4 there is shown a cross section of another dummy warhead shell 37 of configurations matched to the external configurations of the real warhead, which cross section is taken along a plane including the central axis of the dummy warhead shell. The spring bias means for deploying the dummy warhead shells in front of and behind the real warhead comprises a conical coil spring 38 which deforms into a conical configuration conforming with a thin gap between two dummy warhead shell stacked on top of one another in a compressed arrangement.

Figure 5:
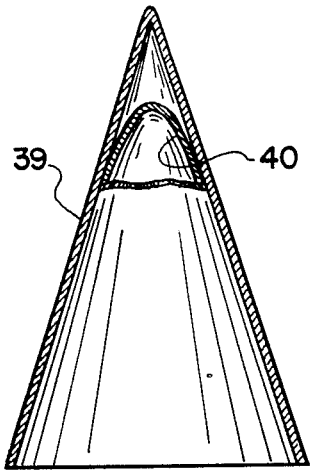
FIG. 5 illustrates a further means for spring-biased deployment of dummy warheads.

In FIG. 5, there is illustrated a cross section of a further dummy warhead shell 39 equipped with a spring bias means for deploying the dummy warhead shells comprising a conical or circular elastic membrane 40 with the base anchored onto the inside surface of the dummy warhead shell. When a dummy warhead shell is stacked on top of another dummy warhead shell in a compressed arrangement, the elastic membrane 40 is stretched into a shape conforming with the conical end of the dummy warhead shells. Consequently, a large number of dummy warhead shells of thin shell construction can be stacked up without occupying a large space.

In FIG. 6, there is shown a train of projectiles following an approximately common trajectory 41 comprising a real warhead and an unspecified number of dummy warhead shells deployed in front of and behind the real warhead by a decoy deploying ICBM warhead constructed in accordance with the principles of the present invention. The first function of the dummy warhead shells is to confuse the ABM system by overwhelming the tracking radars and intercepting missiles by sheer number games. The second function of the dummy warhead shells is to clear the path for the real warhead by destroying the intercepting nets by crashing one or more dummy warhead shells leading the real warhead into the intercepting nets. As mentioned in the description of the operating principles of the decoy deploying ICBM warheads of the present invention, a pack including a plurality of MIRV'ed warheads as well as the individual MIRV warhead thereof can be made into a decoy deploying package as described in the specification of the present invention. Further more, a MIRV package may include all-dummy sub-packs in addition to the real warheads with dummy warhead shells wherein all-dummy sub-packs may be launched to different trajectories by spinning the MIRV package, which will further confuse any defense systems.

While the principles of the present invention have now been made clear by the illustrative embodiments the utilization of the present invention shall not be limited to such illustrative embodiments, as it will be immediately obvious that the skilled in the art may make modifications of the structure, arrangements elements, proportions and materials which are particularly adapted to a specific working environment and operating condition in practicing the invention without departing from the principles of the present invention.

We claim

1. A decoy deploying ICBM warhead comprising in combination:

(a) a plurality of real warheads;

(b) at least one of said plurality of real warheads including at least one stack of a plurality of dummy warhead shells of a substantially thin hollow conical shell construction attached to at least one extremity of said at least one of said plurality of real warheads in a substantially coaxial relationship, said dummy warhead shells having external configuration substantially matched to said real warhead and providing a radar image substantially resembling the radar image of said real warhead;

(c) means for securing said plurality of dummy warhead shells and said real warhead together into a package;

(d) means for separating said plurality of dummy warhead shells and said real warhead from each other, said means included in said package separating said plurality of dummy warhead shells and said real warhead from each other when said means for securing is cut loose;

(e) means for cutting loose said means for securing said plurality of dummy warhead shells and said real warhead together; and (f) means for triggering said means for cutting loose said means for securing said plurality of dummy warhead shells and said real warhead together;

whereby, said decoy deploying ICBM warhead releases a plurality of real warheads and a plurality of dummy warhead shells after said decoy deploying ICBM warhead is launched into space, making it very difficult for radar to distinguish real warheads from said dummy warhead shells.

2. A decoy deploying ICBM warhead comprising in combination:

(a) a real warhead;

(b) said warhead including at least one stack of a plurality of dummy warhead shells of a substantially thin hollow conical shell construction attached to at least one extremity of said real warhead in a substantially coaxial relationship, said dummy warhead shells having an external configuration substantially matched to said real warhead and providing a radar image substantially resembling the radar image of said real warhead;

(c) means for securing said plurality of dummy warhead shells and said real warhead together into a package;

(d) means for separating said plurality of dummy warhead shells and said real warhead from each other, said means included in said package separating said plurality of dummy warhead shells and said real warhead from each other when said means for securing is cut loose;

(e) means for cutting loose said means for securing said plurality of dummy warhead shells and said real warhead together; and (f) means for triggering said means for cutting loose said means for securing said plurality of dummy warhead shells and said real warhead together;

whereby, said decoy deploying ICBM warhead releases a plurality of real warheads and a plurality of dummy warhead shells after said decoy deploying ICBM warhead is launched into space, making it very difficult for radar to distinguish real warheads from dummy warhead shells.

3. A decoy deploying ICBM warhead comprising in combination:

(a) a conical enclosure including a plurality of real warheads;

(b) said conical enclosure including at least one stack of a plurality of dummy conical shells of substantially thin hollow conical shell construction attached to at least one extremity of said conical enclosure in a substantially coaxial relationship, said dummy conical shells having an external configuration substantially matched to said conical enclosure and providing a radar image substantially resembling the radar image of said conical enclosure;

(c) means for securing said plurality of dummy conical shells and said conical enclosure together into a package;

(d) means for separating said plurality of dummy conical shells and said conical enclosure from each other, said means included in said package separating said plurality of dummy conical shells and said conical enclosure from each other when said means for securing is cut loose;

(e) means for cutting loose said means for securing said plurality of dummy conical shells and said conical enclosure together; and (f) means for triggering said means for cutting loose said means for securing said plurality of dummy conical shells and said conical enclosure together;

whereby, said decoy deploying ICBM warhead releases said conical enclosure and said plurality of dummy conical shells after said decoy deploying ICBM warhead is launched into space, making it very difficult for radar to distinguish said conical enclosure from said dummy conical shells.

4. The combination as set forth in claim 3 wherein said combination including:

(a) the plurality of real warheads included in said conical enclosure;

(b) at least one of said plurality of real warheads including at least one stack of a plurality of dummy warhead shells of a substantially thin hollow conical shell construction attached to at least one extremity of said at least one of said plurality of real warheads in a substantially coaxial relationship, said dummy warhead shells having external configuration substantially matched to said real warhead and providing a radar image substantially resembling the radar image of said real warheads;

(c) means for securing said plurality of dummy warhead shells and said real warhead together into a package;

(d) means for separating said plurality of dummy warhead shells and said real warhead from each other, said means included in said package separating said plurality of dummy warhead shells and said real warhead from each other when said means for securing is cut loose;

(e) means for cutting loose said means for securing said plurality of dummy warhead shells and said real warhead together; and (f) means for triggering said means for cutting loose said means for securing said plurality of dummy warhead shells and said real warhead together;

whereby, said decoy deploying ICBM warhead releases a plurality of real warheads and a plurality of dummy warhead shells after said decoy deploying ICBM warhead is launched into space, making it very difficult for radar to distinguish real warheads from said dummy warhead shells.

* * * * *